US007815551B2

(12) United States Patent
Merli

(10) Patent No.: US 7,815,551 B2
(45) Date of Patent: Oct. 19, 2010

(54) SEATED EXERCISE APPARATUS

(76) Inventor: Christopher R Merli, 204 28th St., Boulder, CO (US) 80305

( * ) Notice: Subject to any disclaimer, the term of this patent is extended or adjusted under 35 U.S.C. 154(b) by 70 days.

(21) Appl. No.: 12/209,016

(22) Filed: Sep. 11, 2008

(65) Prior Publication Data

US 2009/0075786 A1 Mar. 19, 2009

Related U.S. Application Data

(60) Provisional application No. 60/993,534, filed on Sep. 13, 2007.

(51) Int. Cl.
*A63B 22/06* (2006.01)

(52) U.S. Cl. ..... 482/63; 482/52; 482/57

(58) Field of Classification Search ..... 482/51, 482/52, 57, 63
See application file for complete search history.

(56) References Cited

U.S. PATENT DOCUMENTS

| | | | | |
|---|---|---|---|---|
| 326,247 | A | 9/1885 | Root | |
| 2,603,486 | A | 7/1952 | Hughes | |
| 2,826,192 | A | 3/1958 | Mangas | |
| 4,188,030 | A | 2/1980 | Hooper | |
| 4,509,742 | A | 4/1985 | Cones | |
| 4,555,109 | A | 11/1985 | Hartmann | |
| 4,645,200 | A | 2/1987 | Hix | |
| 4,684,126 | A | 8/1987 | Dalebout et al. | |
| 4,757,988 | A | 7/1988 | Szymski | |
| 4,869,494 | A | 9/1989 | Lambert, Sr. | |
| 4,900,013 | A | 2/1990 | Rodgers, Jr. | |
| 5,039,088 | A | 8/1991 | Shifferaw | |
| 5,106,081 | A | 4/1992 | Webb | |
| 5,131,895 | A | 7/1992 | Rogers, Jr. | |
| 5,254,067 | A | 10/1993 | Habing et al. | |
| 5,356,356 | A | 10/1994 | Hildebrandt et al. | |
| 5,382,209 | A * | 1/1995 | Pasier et al. | 482/70 |
| 5,505,679 | A | 4/1996 | McBride et al. | |
| 5,514,053 | A | 5/1996 | Hawkins et al. | |

(Continued)

OTHER PUBLICATIONS

PCT International Search Report for PCT/US2008/76264, Applicant: Merli Christopher, Form PCT/ISA/210 and 220, dated Nov. 24, 2008 (4 pages).

(Continued)

*Primary Examiner*—Fenn C Mathew
*Assistant Examiner*—Andrew M Tecco
(74) *Attorney, Agent, or Firm*—Vista IP Law Group LLP

(57) ABSTRACT

A seated exercise apparatus comprises a frame having a seat attached to the frame. A pair of opposed cranks are rotatably coupled to the frame such that they rotate about a first axis. A medial portion of each of a pair of elongated members are rotatably connected to the frame at a second axis. A first end of each elongated member has a handle and a second end of each elongated member is rotatably connected to a one end of a respective pedal arm. The other end of each pedal arm is in turn rotatably connected to a respective crank. Each pedal arm also has a pedal adapted to receive a user's foot. In operation, the apparatus provides the user with coordinated seated exercise of both the arms/hands and legs/feet. The feet move in a generally reciprocating up and down motion and the arms move in a coordinated generally arcuate motion.

15 Claims, 3 Drawing Sheets

U.S. PATENT DOCUMENTS

| | | | | |
|---|---|---|---|---|
| 5,527,250 | A | 6/1996 | Chen | |
| 5,542,893 | A | 8/1996 | Petersen et al. | |
| 5,573,481 | A | 11/1996 | Piercy et al. | |
| 5,611,758 | A | 3/1997 | Rodgers, Jr. | |
| 5,707,321 | A | 1/1998 | Maresh | |
| 5,709,633 | A | 1/1998 | Sokol | |
| 5,795,270 | A | 8/1998 | Woods et al. | |
| 5,836,855 | A | 11/1998 | Eschenbach | |
| 5,916,065 | A * | 6/1999 | McBride et al. | 482/57 |
| 5,938,570 | A | 8/1999 | Maresh | |
| 5,964,682 | A | 10/1999 | Sokol | |
| 6,042,512 | A * | 3/2000 | Eschenbach | 482/52 |
| 6,042,518 | A * | 3/2000 | Hildebrandt et al. | 482/57 |
| 6,077,196 | A * | 6/2000 | Eschenbach | 482/51 |
| 6,077,197 | A | 6/2000 | Stearns et al. | |
| 6,080,088 | A | 6/2000 | Petersen et al. | |
| 6,171,217 | B1 * | 1/2001 | Cutler | 482/57 |
| 6,277,056 | B1 | 8/2001 | McBride et al. | |
| 6,283,895 | B1 | 9/2001 | Stearns et al. | |
| 6,409,635 | B1 | 6/2002 | Maresh et al. | |
| 6,485,395 | B1 | 11/2002 | Stearns et al. | |
| 6,666,799 | B2 * | 12/2003 | Hildebrandt et al. | 482/57 |
| 6,790,162 | B1 | 9/2004 | Ellis et al. | |
| 6,932,745 | B1 | 8/2005 | Ellis | |
| 7,108,637 | B2 * | 9/2006 | Maresh | 482/52 |
| 7,141,003 | B2 | 11/2006 | Wu | |
| 7,377,879 | B1 * | 5/2008 | Chen | 482/51 |
| 7,462,136 | B2 * | 12/2008 | Pan et al. | 482/52 |
| 7,494,448 | B2 * | 2/2009 | Eschenbach | 482/52 |
| 2004/0259692 | A1 * | 12/2004 | Martin et al. | 482/52 |
| 2007/0021277 | A1 | 1/2007 | Kuo | |
| 2007/0099764 | A1 | 5/2007 | Eschenbach | |
| 2007/0161465 | A1 | 7/2007 | Eschenbach | |

OTHER PUBLICATIONS

PCT Written Opinion of the International Search Authority for PCT/US2008/76264, Applicant: Merli, Christopher, Form PCT/ISA/237, dated Nov. 24, 2008 (7 pages).

PCT International Preliminary Report on Patentability (Chapter I of the Patent Cooperation Treaty) for PCT/US2008/076264, Applicant: Merli, Christopher, Form PCT/IB/326 and 373, dated Mar. 25, 2010 (9 pages).

* cited by examiner

SEATED EXERCISE APPARATUS

RELATED APPLICATIONS

This Application claims the benefit of U.S. provisional Application No. 60/993,534, filed on Sep. 13, 2007, in accordance with 35 U.S.C. Section 119(e), and any other applicable laws. U.S. Provisional Application No. 60/993,534 is hereby incorporated by reference in its entirety as if set forth fully herein.

FIELD OF THE INVENTION

The present invention relates to a seated exercise apparatus which is operated in a seated position and which includes foot pedals that move in a reciprocating motion coordinated with handles that move in a reciprocating motion.

BACKGROUND OF THE INVENTION

The benefits of regular exercise are well known and there is always a search for a full body exercise device that can achieve maximum benefit to the user while minimizing impact on their joints. Historically recumbent and upright exercise cycles have been a low impact way of achieving cardiovascular benefit. Recumbent cycles offer the user a much more safe, comfortable and easy-to-use device than an upright exercise cycle and have become very popular among the aging population. More recently recumbent exercise devices have been developed to include a reciprocating or elliptical foot motion.

For example, U.S. Pat. No. 5,514,053 to Hawkins shows a recumbent exercise device with stepping motion but no articulation for the foot. U.S. Pat. No. 5,106,081 to Webb shows a leg exercise machine with an arc motion that is associated with a weight stack. U.S. Pat. No. 6,790,162 Ellis et al. shows a recumbent stepper with independently moving arms. U.S. Pat. No. 6,932,745 to Ellis shows a recumbent exercise apparatus with arcuate foot motion.

Yet another group of recumbent exercise apparatus' has emerged that include coordinated arm movement to achieve a full body workout and, therefore, a higher level of cardiovascular benefit. U.S. Pat. Nos. 5,356,356, 6,042,518, and 6,666,799 all to Hildebrandt et al. show a recumbent apparatus with stepping motion and coordinated arm movement. U.S. Pat. No. 5,611,758 to Rodgers, Jr. shows a recumbent exercise apparatus with elliptical pedal motion using a crank, reciprocating member and roller/track to guide a pedal/foot member pivotally connected to the reciprocating member and includes coordinated arm member movement. U.S. Pat. No. 5,836,855 to Eschenbach, U.S. Pat. Nos. 5,938,570 and 6,409,635 both to Maresh et al., and U.S. Patent Application No. US2004/0259692 to Martin et al. each show pedal movements for a semi-recumbent exerciser. U.S. Patent Application No. 2007/0099764 to Eschenbach describes a recumbent device with elliptical foot motion. The elliptical foot motion is achieved by means of a track system in the preferred embodiment. In an alternative embodiment, elliptical motion is achieved by connection to a rocker link. U.S. Pat. Nos. 6,077,197 and 6,283,895 both to Stearns et al. show inclined pedals and elliptical foot motion where the user is stabilized by leaning against a back support. U.S. Pat. No. 5,916,065 to McBride et al. shows a traditional stand up elliptical configured for use by a seated operator.

Accordingly, there is a need for a seated exercise apparatus with reciprocating foot movement in a generally up and down motion that allows the feet of the user to be generally outside of the bending knee to reduce stress in this area while allowing the foot to articulate in a relatively natural motion. Furthermore, there is a need for a simple, easy to manufacture linkage design without the use of expensive rollers and tracking systems to achieve this motion. Finally there is a need for an apparatus with coordinated arms which do not interfere with the operator's access to the seated area, so that the aging population can use the device without having to get around the moving arms.

SUMMARY OF THE INVENTION

The present invention is directed to a seated exercise apparatus. The seated exercise apparatus comprises a frame and a seat attached to the frame. The seat is configured to support a user in a relatively upright seated position. The frame may include a base portion, which is typically configured to rest firmly on the floor thereby supporting the apparatus. A longitudinal axis of the frame is defined as the axis through the middle of the seat and in the direction along which the seat (and thus the user) faces. The apparatus has a first side located on one side of the longitudinal axis and a second side located on the opposing side of the longitudinal axis. The front of the apparatus (in the direction the seat and seated user face) is defined as the proximal direction, and the back of the apparatus is defined as the distal direction.

First and second cranks are rotatably coupled to the frame in an opposed position such that they rotate about a first axis substantially perpendicular to the longitudinal axis. In other words, the first and second cranks are on opposing sides of the axis and are offset by 180°. The first end of each crank is rotatably connected to the frame at the first axis. The first and second cranks may be attached to a pulley which is in turn rotatably mounted to the frame such that it rotates about the first axis.

A first elongated member having a first end, a second end, and a medial portion is disposed on the first side of the apparatus. The medial portion of the first elongated member is rotatably connected to the frame such that the first elongated member may rotate about a second axis which is substantially perpendicular to the longitudinal axis of the frame. Similarly, a second elongated member having a first end, a second end, and a medial portion is disposed on the second side of the apparatus. The second elongated member is rotatably connected to the frame at the medial portion of the second elongated member such that the second elongated member also may rotate about the second axis. Each first end of the elongated members has a handle for the user to hold with each hand. The medial portion of the first and second elongated members may be positioned proximal the seat sufficiently spaced from the seat to allow room for the user to access the seat without being blocked by the elongated members or the handles.

A first pedal arm having a first end, a second end and pivot portion is disposed on the first side of the apparatus distal of the first elongated member. The first end of the first pedal arm is rotatably connected to the second end of the first crank. A pedal configured to support the foot of the user is operably connected to the first pedal arm proximate the second end of the pedal arm. The pivot portion of the first pedal arm is rotatably connected to the second end of the first elongated member, such that a downward force on the pedal causes (i) the first crank to rotate about the first axis, (ii) the first elongated member to rotate about the second axis, (iii) and the first pedal to move in a steep up and down reciprocating motion.

Likewise, a second pedal arm having a first end, a second end and a pivot portion is disposed on the second side of the apparatus distal of the second elongated member. The first end of the second pedal arm is rotatably connected to the second end of the second crank. The pivot portion of the second pedal arm is rotatably connected to the second end of the second elongated member, such that a downward force on the pedal causes (i) the second crank to rotate about the first axis, (ii) the second elongated member to rotate about the second axis, (iii) and the second pedal to move in a steep up and down reciprocating motion.

As the pedals are reciprocated up and down, the handles move in coordination with the motion of the cranks resulting in an arcuate motion of the handles about the second axis.

Thus, the present invention provides the user with coordinated seated exercise of both the arms/hands and legs/feet. The feet move in a generally reciprocating motion and articulate in a manner which is natural to the preferred movement of the ankle. The arms are coordinated with this foot motion in a generally arcuate motion.

Additional aspects and features of the seated exercise apparatus and related mechanisms of the present invention will become apparent from the drawings and detailed description provided below.

BRIEF DESCRIPTION OF THE DRAWINGS

The invention is illustrated by way of example and not limitation in the figures of the accompanying drawings, in which like reference numbers refer to similar elements, and in which.

DETAILED DESCRIPTION OF THE INVENTION

Figure 1:
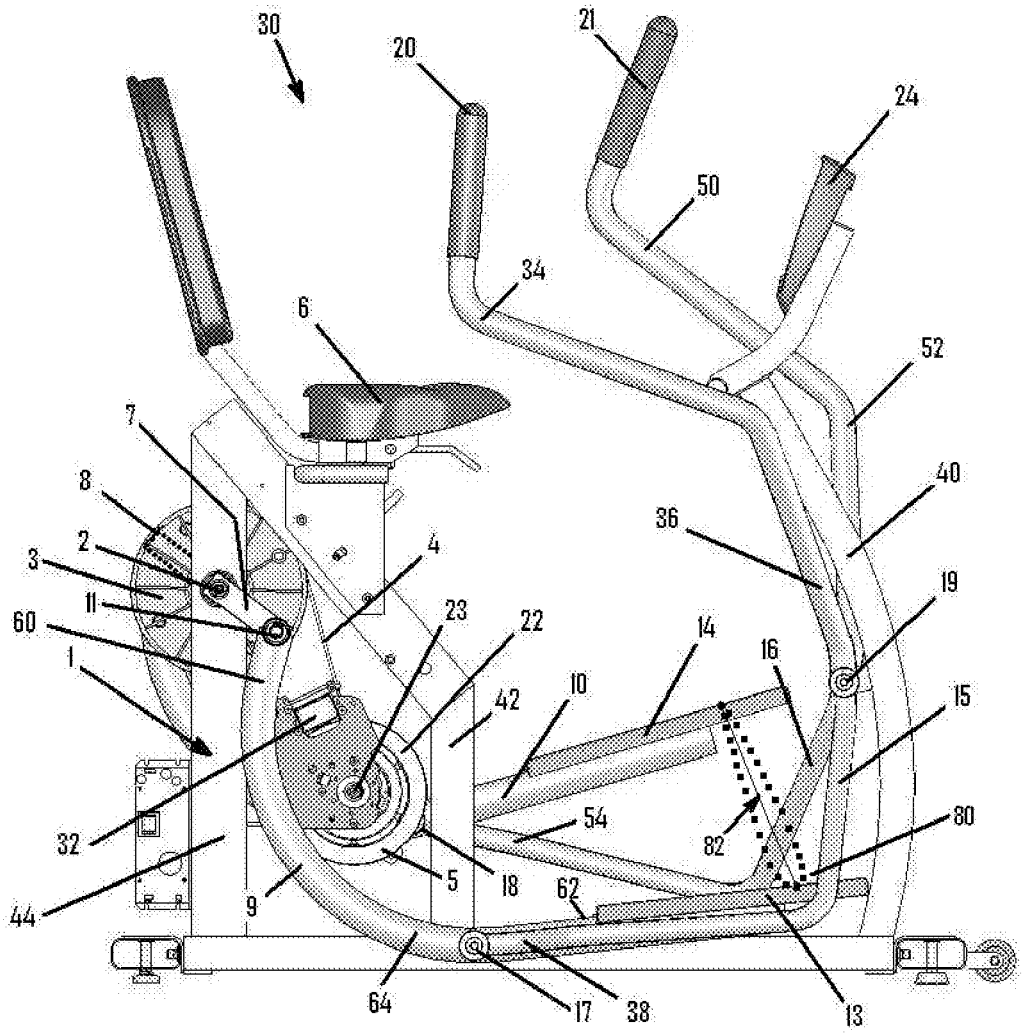
FIG. 1 is a side elevation view of one embodiment of the present invention.
Figure 2:
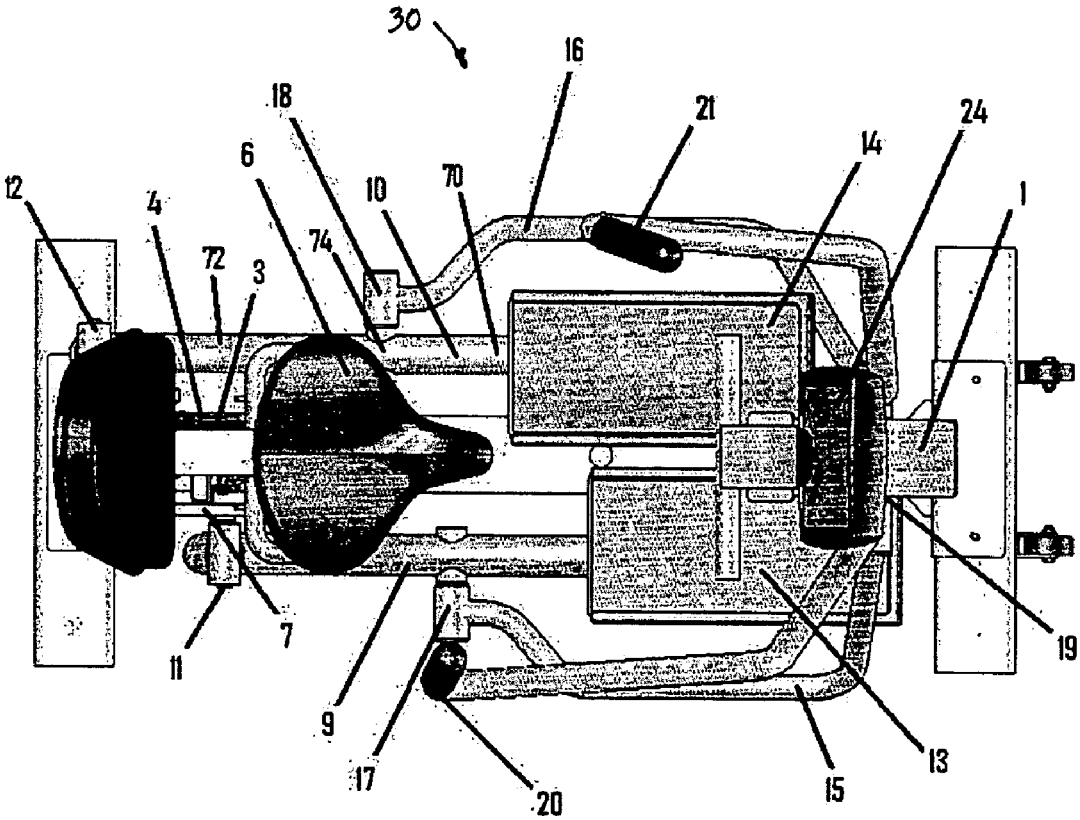
FIG. 2 is a plan view of embodiment of FIG. 1.

Referring to FIGS. 1 and 2, an exemplary embodiment of a seated exercise apparatus 30 is shown. The seated exercise apparatus 30 comprises a frame 1 which may be constructed of any suitably strong material, such as steel, aluminum, composite, or other suitable material(s). The frame 1 includes a base portion which extends from the back or distal end to the front or proximal end of the apparatus 30, along a longitudinal axis extending through the middle of the seat 6. The longitudinal axis also divides the apparatus horizontally into a first side on one side of the longitudinal axis and a second side on the other side of the longitudinal axis. In other words, the first side of the apparatus 30 is the right side of the user seated in the seat 6, and the second side is the left side, or vice versa. The base portion has four feet having adjustable heights which provide for a firm and stable foundation on a support surface such as the floor, and also allows for some leveling of the apparatus 30. The frame 1 further includes a plurality of risers, including in this exemplary embodiment, a front riser 40, a seat riser 42, and a crank riser 44.

A seat 6 is attached to the seat riser. The seat 6 and seat riser 42 may be configured to adjust the seat position. In this example, the seat riser 42 includes a plurality of positions which adjust the seat's vertical and horizontal position so that the seat 6 can be adjusted to fit the particular user. The seat 6 may include a seat back. The seat 6 is oriented to position the user in a substantially upright seated position.

A first crank 7 and second crank 8, each having a first end, and a second end are arranged substantially opposed to each other and positioned below and distal the seat 6. The first end of the first and second cranks 7, 8 are rotatably coupled to the frame 1 at the crank riser 44, such as through an axle, sleeve and bearings, or other suitable structure, such that the first and second cranks 7, 8 rotate about a first axis 2 defined by the axle, where the first axis 2 is substantially perpendicular to the longitudinal axis of the apparatus 30. The first crank 7 and second crank 8 are typically disposed on opposing sides of the axle. The first and second cranks 7, 8 may be rotatably coupled to the frame through attachment to pulley 3 which is coupled to the frame using, for example, an axle, sleeve, and bearings, or other suitable structure.

A flywheel 22 is rotatably coupled to the frame 1 at the crank riser 44 through a pivot axis 23, below and slightly proximal of the pulley 22 and first and second cranks 7, 8. The flywheel 22 is operably coupled to the pulley 3 by a belt 4. The belt 4 may be a chain, a belt, or other suitable, flexible engagement. An adjustable load resistance device 32 is operably coupled to the flywheel 22, and in turn to the pulley 3, to provide an adjustable load resistance on the pulley 3. The load resistance device 32 may use magnetic resistance, friction, an alternator, a fan, or other suitable adjustable load resistance mechanism. The load resistance device 32 may be operably coupled to a user console 24 configured to adjust the load resistance. A controller may be provided which is operably coupled to the load resistance device. The controller is configured to receive control signals from the console 24 and use the signals to properly adjust the load resistance device 32. The load resistance device 32 may also be controlled mechanically using brake pads and a hand operated control knob.

A first elongated member 15 having is provided on the first side of the apparatus 30. The first elongated member 15 includes a first end 34, a second end 38, and a medial portion 36. The first end 34 is positioned generally proximal of a seated user and to the outside of the seat 6. The first end 34 has a handle 20 for a user to grip with their right hand. The first elongated member 15 extends from the handle 20 in a forward direction toward the proximal end of the apparatus 30. The medial portion 36 of the first elongated member 15 is positioned proximal the seat 6 and extends generally vertically downward so that it provides room for a user to mount the seat 6 without being hindered by the first elongated member 15 or the handle 20. The medial portion 36 is rotatably connected to the frame 1 at the front riser 40 at a second axis 19 which is transverse to the longitudinal axis, such that the first elongated member 15 rotates about the second axis 19. The first elongated member 15 then extends from the generally vertical medial portion 36 through a curved portion and along a generally horizontal portion to the second end 38, which is positioned near the bottom of the apparatus 30.

A second elongated member 16 is disposed on the second side of the apparatus 30, and is a mirror image of the first elongated member 15, in both structure and coupling to the apparatus 30. The second elongated member 16 includes a first end 50, a second end 54, and a medial portion 52. The first end 50 is positioned generally proximal of a seated user and to the outside of the seat 6. The first end 50 has a handle 21 for a user to grip with their left hand. The second elongated member 16 extends from the handle 21 in a forward direction toward the proximal end of the apparatus 30. The medial portion 52 of the second elongated member 16 is positioned proximal the seat 6 and extends generally vertically downward so that it provides room for a user to mount the seat 6 without being hindered by the second elongated member 16 or the handle 21. The medial portion 52 is rotatably connected to the frame 1 at the front riser 40 at the second axis 19, such that the second elongated member 16 rotates about the second axis 19. The second elongated member 16 then extends from the generally vertical medial potion 52 through a curved portion and along a generally horizontal portion to the second end 54, which is positioned near the bottom of the apparatus 30.

A first pedal arm 9 having a first end 60, a second end 62, and a pivot portion 64 is disposed on the first side of the apparatus 30, with the first end 60 distal of the first elongated member 15 and the second end 62 proximal of the second end 38 of the first elongated member 15. The first end 60 of the pedal arm 9 is rotatably connected to the second end of the first crank 7 at pivot 11. The pivot portion 64 of the first pedal arm 9 is rotatably connected to the second end 38 of the first elongated member 15 at pivot 17. A first pedal 13 configured to support the right foot of the user is operably connected to the first pedal arm 9 proximate the second end 62 of the first pedal arm 9. The location of the pivot 17 relative to the first pedal 13 will determine the up and down motion of the first pedal 13, and can be changed according to the present invention. For example, if the pivot 17 is located distal of the first pedal 13, the first pedal 13 will have a reciprocating motion up and down in a generally elliptical path 80 having a major axis 82, as shown in FIG. 1. If the first pedal 13 is placed directly over the pivot 17, then the first pedal 13 will move in a reciprocating motion up and down motion in an arcuate path. The more the pivot 17 is moved distally of the first pedal 13, the more elliptical the pedal path will be. Thus, a downward force on the first pedal 13 causes the first crank 7 to rotate in a counterclockwise direction about the first axis 2, in turn the first elongated member 15 rotates about the second axis 19, and the first pedal 13 moves in a steep up and down reciprocating motion (which may be arcuate or elliptical). The rotation of the first elongated member 15 about the second axis 19 causes the handle 20 to move through a reciprocating arcuate motion, which provides for coordinated movement of the first pedal 13 and the handle 20 (i.e. a complete cycle of the first pedal 13 corresponds to a complete cycle of the handle 20).

Likewise, a second pedal arm 10 having a first end 72, a second end 70, and a pivot portion 74 is disposed on the second side of the apparatus 30, with the first end 72 distal of the second elongated member 16 and the second end 70 proximal of the second end 54 of the second elongated member 16. The first end 72 of the second pedal arm 10 is rotatably connected to the second end of the second crank 8 at pivot 12. The pivot portion 74 of the second pedal arm 10 is rotatably connected to the second end 54 of the second elongated member 16 at pivot 18. A second pedal 14 configured to support the left foot of the user is operably connected to the second pedal arm 10 proximate the second end 70 of the second pedal arm 10. The location of the pivot 18 relative to the second pedal 14 will determine the up and down motion of the second pedal 14, and can be changed according to the present invention. For example, if the pivot 18 is located distal of the second pedal 14, the second pedal 14 will have a reciprocating motion up and down in a generally elliptical path. If the second pedal 14 is placed directly over the pivot 18, then the second pedal 14 will move in a reciprocating motion up and down motion in an arcuate path. The more the pivot 18 is moved distally of the second pedal 14, the more elliptical the pedal path will be. Similar to the first pedal 13 described above, a downward force on the second pedal 14 causes the second crank 8 to rotate in a clockwise direction (when facing the second crank 8) about the first axis 2, in turn the second elongated member 16 rotates about the second axis 19, and the second pedal 14 moves in a steep up and down reciprocating motion (which may be arcuate or elliptical). The rotation of the second elongated member 16 about the second axis 19 causes the handle 21 to move through a reciprocating arcuate motion, which provides for coordinated movement of the second pedal 14 and the handle 10.

Figure 3:
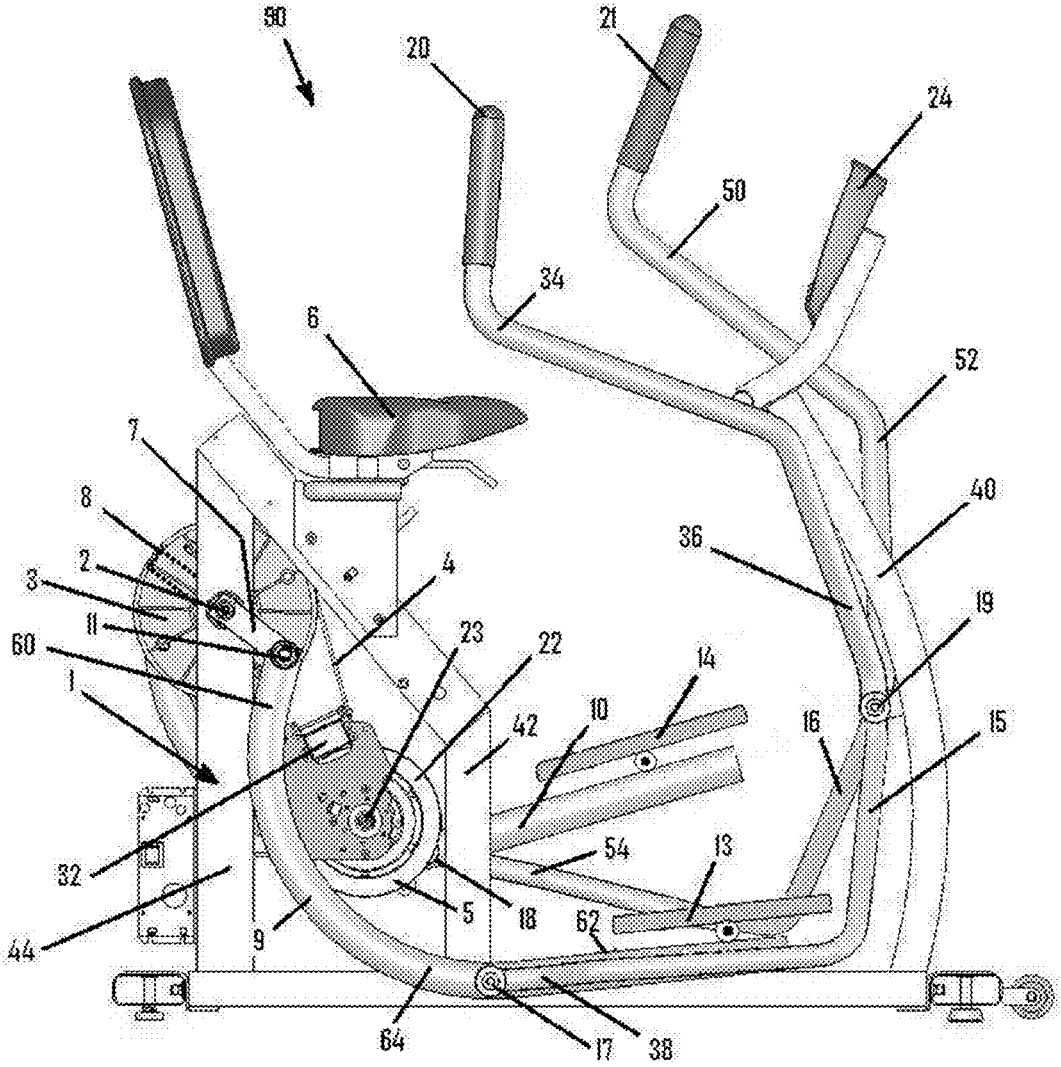
FIG. 3 is a side elevation view of another embodiment of the present invention.

Referring now to FIG. 3, another embodiment of a seated exercise apparatus 90 is shown, which is identical to the seated exercise apparatus 30, except that the first pedal 13 is rotatably connected to the first pedal arm 9 and the second pedal 14 is rotatably connected to the second pedal arm 10.

The apparatus 30 is configured such that the reciprocating path of the first and second pedals 13, 14 is in a generally elliptical path 80 having a major axis 82 which is more vertical than horizontal, especially as compared to prior recumbent designs as described above, and preferably at an angle of greater than 45 degrees to the floor, or at an angle of greater than 60 degrees to the floor, or at an angle of greater than 70 degrees to the floor, or at an angle of greater than 80 degrees (wherein vertical to the floor is 90 degrees). This more vertical up and down motion of the pedal 13, 14 provides a more natural motion and creates less stress on the joints than the devices described above in which the pedals travel on a more horizontal path as the user is in a reclined position.

During operation the user sits in a generally upright position with their body supported by seat 6. The user applies force to the first and second pedals 13, 14 resulting in a foot motion that is generally reciprocating. First and second pedals 13, 14 articulate in a manner that allows plantar flexion in the lower pedal position and dorsi flexion in the upper pedal position. The first and second handles 20, 21 move in an arcuate motion during operation of the first and second pedals 13, 14. As all of the moving parts are coupled at least indirectly to the rotation of the pulley 3, the motion of the first and second pedals 13, 14 and the first and second handles 20, 21 are coordinated.

The first and second pedals 13, 14 throughout their motion are located proximal of the seat 6. Thus, it can be seen that the exercise apparatus 30 places less stress on the user's knees and is easily accessible for older users. Moreover, the apparatus 30 uses relatively simple pivot mechanisms, making the device easy to manufacture and assemble.

While embodiments of the present invention have been shown and described, various modifications may be made without departing from the scope of the present invention. The invention, therefore, should not be limited, except to the following claims, and their equivalents.

What is claimed is:

1. An apparatus for exercising having a first axis toward the rear end of the apparatus and a second axis toward the front end of the apparatus, comprising:

a frame configured to be supported on a floor, said first axis being on said frame and being substantially perpendicular to a longitudinal axis of said apparatus;

a seat attached to said frame, said seat adapted to support a user in a seated position;

first and second cranks, each said crank having a first and second end, each of said first ends of said first and second cranks rotatably coupled to the frame at said first axis such that the first and second cranks rotate about said first axis;

first and second elongated members each having a first end, a second end, and a medial portion, said medial portion of said first elongated member rotatably connected to said frame and configured to rotate about a second axis which is substantially perpendicular to said longitudinal axis, said medial portion of said second elongated member rotatably connected to said frame and configured to rotate about said second axis, said first end of each said elongated member having a handle;

first and second pedal arms each having a first end, a second end and a pivot portion between said first end and said second end, said first end of said first pedal arm rotatably connected to said second end of said first crank, said pivot portion of said first pedal arm rotatably connected to said second end of said first elongated member at a first pivot, said first end of said second pedal arm rotatably connected to said second end of said second crank, said pivot portion of said second pedal arm rotatably connected to said second end of said second elongated member at a second pivot;

first and second pedals each configured to support the foot of a seated user, said first pedal operably connected to said first pedal arm in front of said first pivot, said second pedal operably connected to said second pedal arm in front of said second pivot, whereby said pedals move in a generally reciprocating pattern along an elongated curvilinear path; and wherein said elongated curvilinear path has a major axis which forms an acute angle to the floor of greater than 45 degrees.

2. The apparatus of claim 1 wherein said first pedal is rigidly connected to said first pedal arm, and said second pedal is rigidly connected to said second pedal arm.

3. The apparatus of claim 1 wherein said first pedal is rotatably connected to said first pedal arm, and said second pedal is rotatably connected to said second pedal arm.

4. The apparatus of claim 1 further comprising a pulley to which said first and second cranks are attached, said pulley rotatably connected to said frame and configured to rotate about said first axis.

5. The apparatus of claim 4 further comprising a load resistance device operably coupled to said pulley and configured to provide an adjustable load resistance on said pulley.

6. The apparatus of claim 1, wherein said pivot portion of said first pedal arm is positioned lower than said first and second ends of said first pedal arm, and said pivot portion of said second pedal arm is positioned lower than said first and second ends of said second pedal arm.

7. The apparatus of claim 1, further comprising an adjustable load resistance device operably coupled to said first and second cranks.

8. The apparatus of claim 4, further comprising a flywheel operably engaged to said pulley via a belt.

9. An apparatus for exercising having a first axis toward the rear end of the apparatus and a second axis toward the front end of the apparatus, comprising:

a frame configured to be supported on a floor, said first axis being on said frame and being substantially perpendicular to a longitudinal axis of said apparatus;

a seat attached to said frame, said seat adapted to support a user in a seated position;

first and second cranks , each said crank having a first and second end, each of said first ends of said first and second cranks rotatably coupled to the frame at said first axis such that the first and second cranks rotate about said first axis;

first and second elongated members each having a first end, a second end, and a medial portion, said medial portion of said first elongated member rotatably connected to said frame at the front end of the apparatus and configured to rotate about a second axis which is substantially perpendicular to said longitudinal axis, said second axis being vertically lower than said first axis; said medial portion of said second elongated member rotatably connected to said frame at the front end of the apparatus and configured to rotate about said second axis, said first end of each said elongated member having a handle;

first and second pedal arms each having a first end, a second end and a pivot portion between said first end and said second end, said first end of said first pedal arm rotatably connected to said second end of said first crank, said pivot portion of said first pedal arm rotatably connected to said second end of said first elongated member at a first pivot, said first end of said second pedal arm rotatably connected to said second end of said second crank, said pivot portion of said second pedal arm rotatably connected to said second end of said second elongated member at a second pivot;

first and second pedals each configured to support the foot of a seated user, said first pedal operably connected to said first pedal arm, said second pedal operably connected to said second pedal arm, whereby said first and second pedals move in a generally reciprocating pattern along an elongated curvilinear path; and wherein said elongated curvilinear path has a major axis which forms an acute angle to the floor of greater than 45 degrees.

10. The apparatus of claim 9 wherein said first pedal is rigidly connected to said first pedal arm, and said second pedal is rigidly connected to said second pedal arm.

11. The apparatus of claim 9 wherein said first pedal is rotatably connected to said first pedal arm, and said second pedal is rotatably connected to said second pedal arm.

12. The apparatus of claim 9 further comprising a pulley to which said first and second cranks are attached, said pulley rotatably connected to said frame and configured to rotate about said first axis.

13. The apparatus of claim 12 further comprising a load resistance device operably coupled to said pulley and configured to provide an adjustable load resistance on said pulley.

14. The apparatus of claim 9, wherein said pivot portion of said first pedal arm is positioned lower than said first and end second ends of said first pedal arm, and said pivot portion of said second pedal arm is positioned lower than said first and end second ends of said second pedal arm.

15. The apparatus of claim 9, wherein said first pedal is operably connected to said first pedal arm in front of said first pivot, and said second pedal is operably connected to said second pedal arm in front of said second pivot.

* * * * *